US005592961A

United States Patent [19]

Chin

[11] Patent Number: 5,592,961

[45] Date of Patent: Jan. 14, 1997

[54] PORTABLE BOOTH

[76] Inventor: Anna H. K. Chin, 820 Champion Cir., Walnut, Calif. 91789

[21] Appl. No.: 583,517

[22] Filed: Jan. 5, 1996

[51] Int. Cl.[6] ..... E04H 15/40

[52] U.S. Cl. ..... 135/125; 135/117; 135/126; 135/128; 135/901; 135/90

[58] Field of Search ..... 135/87, 90, 95, 135/137, 143, 900, 901, 902, 116, 117, 126, 128

[56] References Cited

U.S. PATENT DOCUMENTS

| | | | |
|---|---|---|---|
| 1,713,439 | 5/1929 | Klyaich . | |
| 1,803,626 | 5/1931 | Lasley . | |
| 1,804,190 | 5/1931 | Wendel . | |
| 2,167,861 | 8/1939 | Zimmern et al. . | |
| 2,612,900 | 10/1952 | Treppa . | |
| 2,781,766 | 2/1957 | Krieger . | |
| 4,067,346 | 1/1978 | Husted | 135/901 X |
| 4,224,754 | 9/1980 | Derryberry | 135/901 X |
| 4,285,354 | 8/1981 | Beavers | 135/90 X |
| 4,825,578 | 5/1989 | Robinson | 135/901 X |
| 4,928,581 | 5/1990 | Jacobson | 135/117 X |
| 4,951,333 | 8/1990 | Kaiser et al. | 135/126 X |
| 4,979,242 | 12/1990 | Maggio . | |
| 5,038,812 | 8/1991 | Norman . | |
| 5,163,461 | 11/1992 | Ivanovich et al. | 135/126 |
| 5,249,592 | 10/1993 | Springer et al. | 135/126 |
| 5,343,887 | 9/1994 | Danaher | 135/128 X |
| 5,411,046 | 5/1995 | Wan | 135/126 X |
| 5,429,148 | 7/1995 | Hammer | 135/116 X |
| 5,430,980 | 7/1995 | Ferrier | 135/902 X |
| 5,439,017 | 8/1995 | Brown . | |
| 5,467,794 | 11/1995 | Zheng | 135/117 X |

FOREIGN PATENT DOCUMENTS

| | | |
|---|---|---|
| 0235954 | 6/1925 | United Kingdom . |
| 0344798 | 3/1931 | United Kingdom . |

*Primary Examiner*—Wynn E. Wood

*Attorney, Agent, or Firm*—Denton L. Anderson; Steven G. Roeder; Sheldon & Mak, Inc.

[57] ABSTRACT

A portable booth is provided which includes a plurality of vertical sides, a top panel, and a bottom panel attached together to form an enclosure which can be twisted into a compact assembly unit. A first stiffener and second stiffener can be added to the enclosure to provide additional stability to the portable booth. The first and second stiffeners can each be twisted into a compact stiffener unit. Since the side panels can be easily twisted to form a compact assembly unit and the first and second stiffeners can each be twisted to form a compact stiffener unit, the portable booth is easy to assemble and disassemble, and easy to transport.

18 Claims, 3 Drawing Sheets

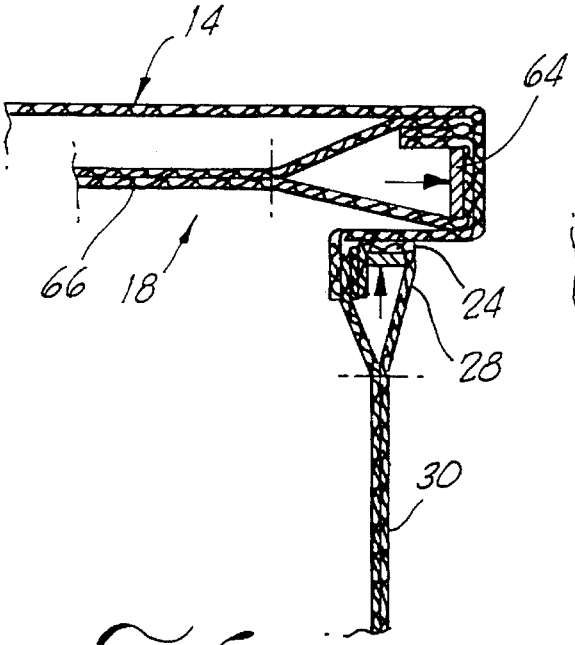
FIG. 6.
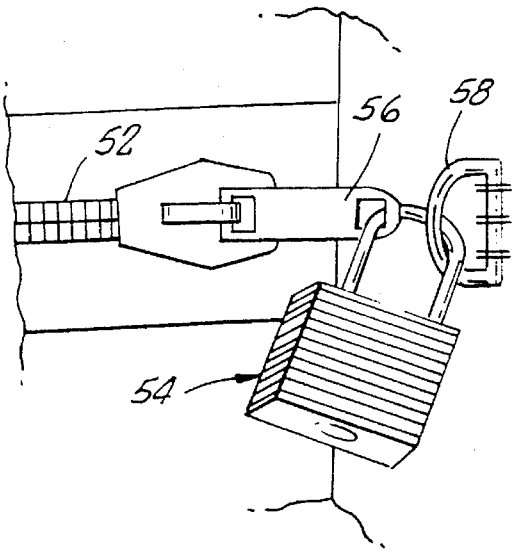
FIG. 7.
FIG. 10.
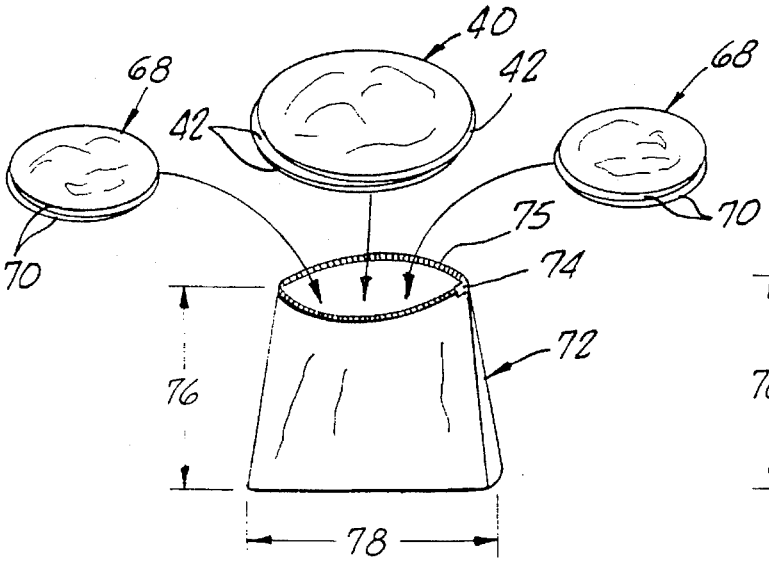
FIG. 11.
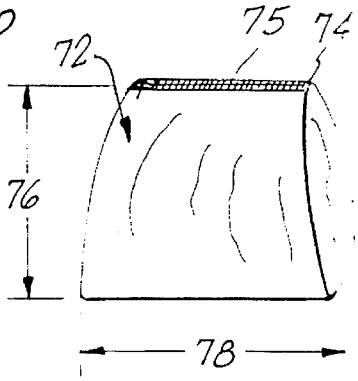

PORTABLE BOOTH

BACKGROUND

This invention is directed to a portable booth useful for providing a private, portable changing room at remote locations such as sidewalk sales, yard sales and the beach.

Changing rooms are commonly used in the clothing industry to allow patrons to try on clothes prior to selecting the clothes. However, changing rooms are rarely available at remote locations such as sidewalk sales, yard sales and the beach. Thus, portable changing rooms are useful for providing an enclosed structure at such remove locations.

However, prior art portable changing rooms have proved not to be entirely satisfactory since these portable changing rooms can be expensive, bulky, difficult to assemble and disassemble, difficult to transport and relatively fragile.

Accordingly, there is a need for an inexpensive, durable, light-weight, and easily transported portable booth which can be assembled and disassembled quickly and easily.

SUMMARY

The present invention is directed to a portable booth that meets these needs. A portable booth according to the present invention comprises a plurality of elongate, substantially vertical side panels. Each side panel has a pair of opposed, substantially parallel side edges, an upper end edge and an lower end edge. The side panels are attached side edge to side edge to form an enclosure having an upper end and a lower end.

During disassembly of the portable booth, the upper end edge and the lower end edge of at least one of the side panels can be twisted in opposite rotational directions to form a compact assembly unit comprising at least two substantially parallel assembly moieties. Preferably, for ease of assembly and disassembly, the plurality of side panels can be stacked to form a contiguous multi-layer assembly having opposed first and second ends and a longitudinal axis and the first and second ends of the multi-layer assembly can be twisted in opposite rotational directions around the longitudinal axis to form a compact assembly unit comprising at least two substantially parallel assembly moieties. Since the portable booth can be reduced into the compact assembly unit, it is readily transportable.

Preferably, each side panel is made of a durable, light-weight, flexible material, such as nylon which covers a continuous band of spring material so that the side panels are lightweight and durable.

The portable booth can include a flexible top panel attached to the upper end edges of each of the side panels to form a roof for the enclosure and a flexible bottom panel attached to the lower end edges of each of the side panels to form a floor for the enclosure. Preferably, the top panel and the bottom panel are also made of a durable, lightweight material such as nylon to keep the weight of the portable booth to a minimum.

Preferably, to provide additional stability to the portable booth, a first stiffener comprising a flexible material covering a continuous band of spring material and a second stiffener comprising a flexible material covering a continuous band of spring material can be added to the portable booth. The first stiffener fits within the upper end of the enclosure and is sized and dimensioned to fit horizontally and snugly ,within the upper end of the enclosure. The second stiffener fits within the lower end and is sized and dimensioned to fit horizontally and snugly within the lower end of the enclosure. Each of the first and second stiffeners can be twisted to form a compact stiffener unit having at least two substantially parallel stiffener moieties so that the first and second stiffeners are easily transported.

The present invention provides a portable booth which is lightweight, durable, resilient, and easy to assemble and disassemble. Further, the portable booth is readily transportable since the portable booth includes side panels which can be reduced to a compact assembly unit and first and second stiffeners which can each be reduced to a compact stiffener unit.

DRAWINGS

These and other features, aspects and advantages of the present invention will become better understood from the following description, appended claims and accompanying drawings where:

FIG. 6 is a cut-away view taken on lines 6—6 of FIG. 1;

FIG. 7 is a partial cut-away view of a zipper and a padlock useful for locking the access door of FIG. 2;

FIG. 10 is a perspective view illustrating the compact assembly unit and two compact stiffener units being placed inside a tote bag; and FIG. 11 is a perspective view of the tote bag of FIG. 10 containing the portable booth.

DESCRIPTION

Figure 1:
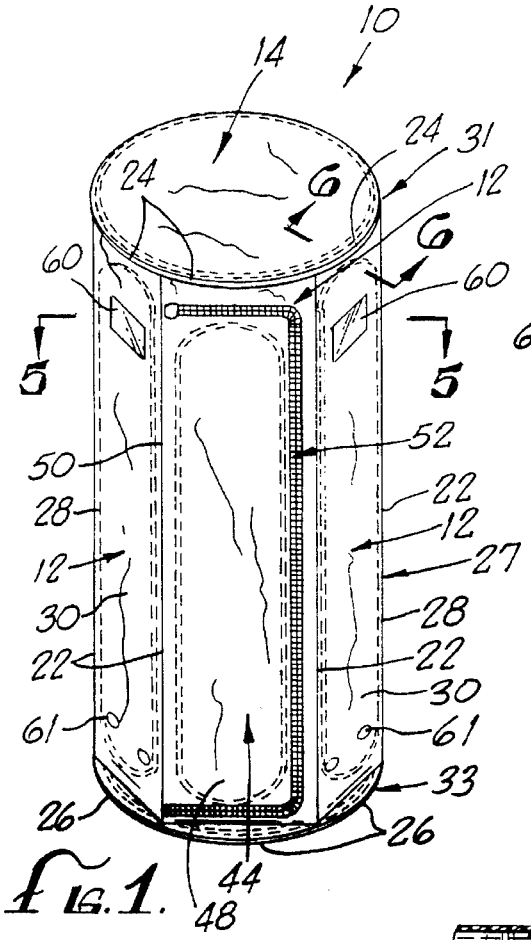
FIG. 1 is a perspective view of a portable booth having features of the present invention.

The following discussion describes in detail one embodiment of the invention and several variations of that embodiment. This discussion should not be construed as limiting the invention to that particular embodiment or to those particular variations. Practitioners skilled in the art will recognize numerous other embodiments and variations, as well. For a definition of a complete scope of the invention, the reader is directed to the appended claims.

A portable booth 10 according to the present invention comprises (i) a plurality of elongate, substantially vertical side panels 12; (ii) a top panel 14; (iii) a bottom panel 16 (iv) a first stiffener 18; and (v) a second stiffener 20.

Figure 2:
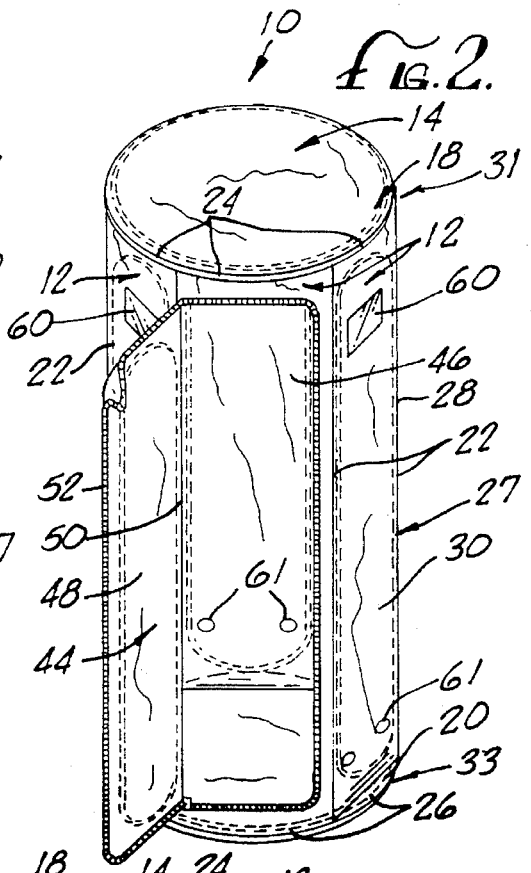
FIG. 2 is a perspective view of the portable booth of FIG. 1 having an access door which is open.
Figure 3:
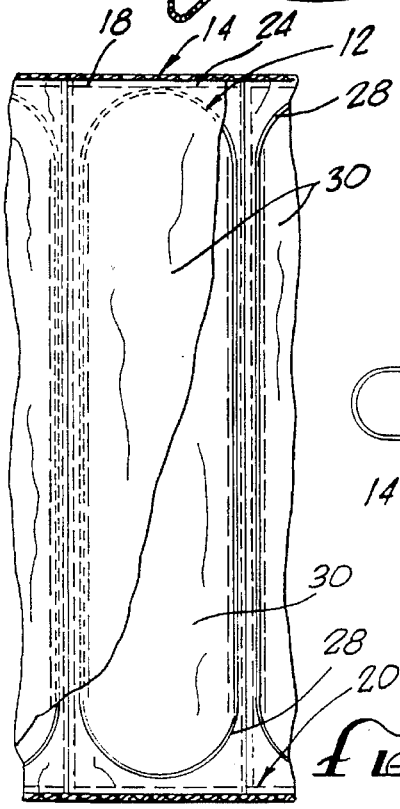
FIG. 3 is a side plan view of a portion of the portable booth, with partial cut-away of a side panel of the portable booth.

Each side panel includes a pair of opposed, substantially parallel side edges 22, an upper end edge 24 and a lower end edge 26. Preferably, each side panel 12 comprises a continuous band of spring material 28 which forms the frame of the side panel 12 and a lightweight, thin, flexible material 30 covering the continuous band of spring material 28 so that each of the side panels 12 is sturdy and lightweight. As shown in FIGS. 1—3, each of the side panels 12 comprises an oval-shaped continuous band 28 covered by two pieces of thin, flexible material 30 sewn together around the continuous band 28. Nylon makes an excellent flexible material since it is durable, resilient and water proof.

Since the continuous band of spring material 28 forms the frame which supports each of the side panels 12, the strength of each of the side panels 12 is determined by the thickness of the continuous band 28 and the material used for making the continuous band 28. Spring steel is an excellent material for the continuous band of spring material 28 since spring steel is strong and resilient. A spring steel continuous band 28 having a thickness of about 1/32 inches and width of about 1/8 inches provides a strong structure which is also flexible.

The side panels 12 are attached together side edge 22 to side edge 22 to form an enclosure 27 having an upper end 31 and lower end 33. The side panels 12 can be attached by sewing the flexible material 30 on the side panels 12 together or attaching them together by some other means such as tape or a velcro-type attachment.

The size of the side panels 12 and the number of side panels 12 determine the size of the portable booth 10. The number of side panels 12 can be between about four (4) and about twelve (12), and more preferably between six (6) and eight (8) side panels 12 for ease of assembly and disassembly. The size of the side panels 12 can vary according to the size of portable booth 10 desired. The embodiment shown in the Figures is a portable booth 10 for children and has six side panels 12 with a height of about 48 inches and a width of about 13 inches. A portable booth 10 for an adult will require larger and/or more side panels 12. A height of between about thirty-six (36) to ninety-six (96) inches and a width of between about ten (10) to thirty-six (36) inches can be used for each side panel 12.

Figure 9:
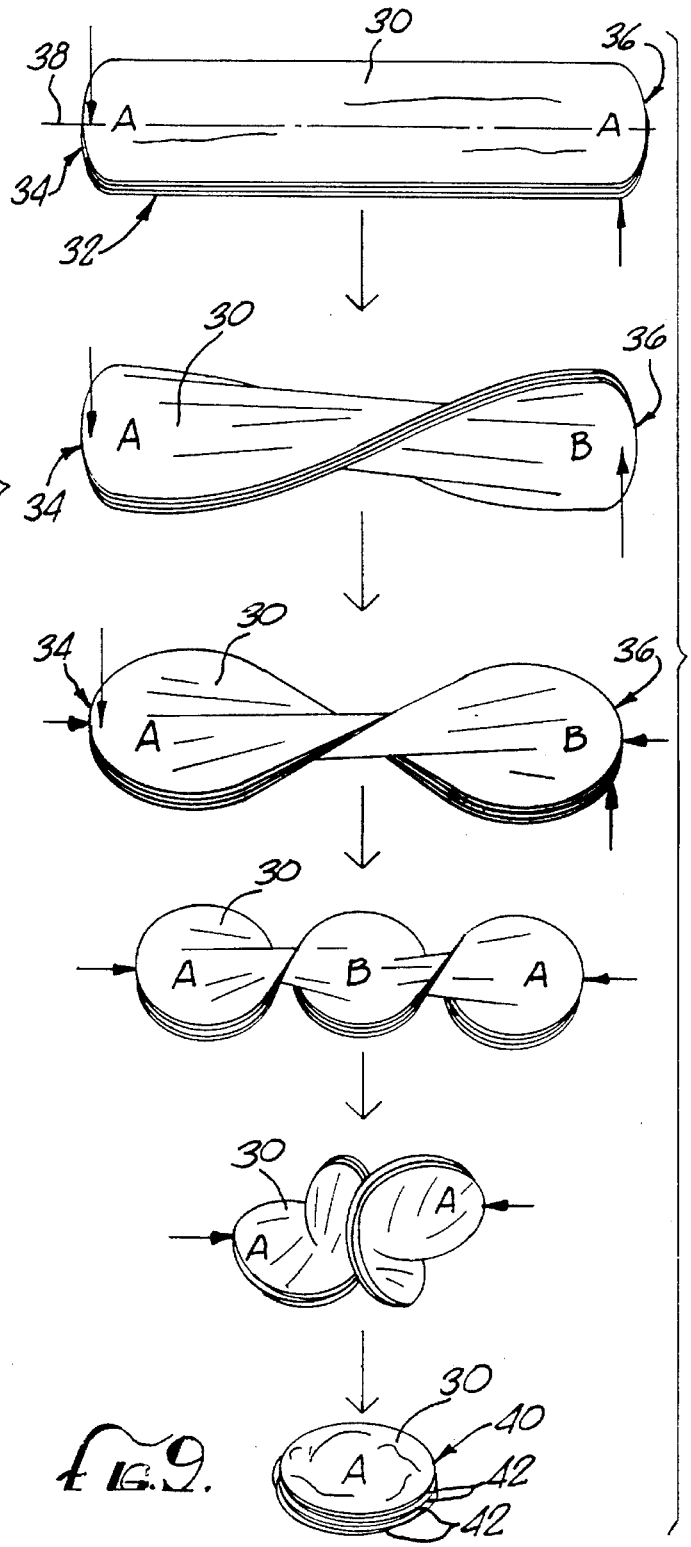
FIG. 9 is a series of perspective views illustrating the multi-layer assembly being twisted to form a compact assembly unit.

During disassembly, each of the plurality of side panels 12 are stacked on the other side panels to form a continuous multi-layer assembly 32 having a first end 34, a second end 36 and a longitudinal axis 38. Thus, the multi-layer assembly 32 will have a width and length which is approximately equal to the width and length of one of the side panels 12 and a thickness which is approximately equal to the thickness of the plurality of side panels 12 added together. As shown in FIG. 9, the first and second ends 34, 36 of the multi-layer assembly 32 can then be twisted in opposite directions around the longitudinal axis 38 to form a compact assembly unit 40 comprising at least two, and more preferably three, substantially parallel assembly moieties 42. With reference to FIG. 9, the second end 36 is twisted three hundred sixty (360°) degrees relative to the first end 34. Next, the first and second ends 34, 36 are rotated toward each other to form the assembly moieties 42. The size of the assembly moieties 42 depends upon the size of the multi-layer assembly 32. As shown in FIG. 9, the continuous multi-layer assembly 32 can be twisted into at three substantially parallel assembly moieties 42 having a circular cross-section of about ten (10) to twenty (20) inches and a combined height of about one (1) to four (4) inches.

Preferably, at least one of the side panels 12 includes an access door 44 which allows access into the enclosure 27. As shown in FIG. 2, the access door 44 can be an opening 46 in the side panel 12 which is covered by a flap 48 which is made of a durable, flexible material 30, such as nylon. The flap 48 can be secured in a number of ways. In the embodiment shown in FIG. 2, a back portion 50 of the flap 48 is sewn to one of the side panels 12 and a zipper 52, attached to the flap 48 and the side panel 12 is used to open and close the access door 44. As shown in FIG. 7, a padlock 54 can be used to secure a handle 56 of the zipper 52 to a ring 58 which is sewn onto one of the side panels 12 to lock the access door 44.

Further, at least one of the side panels 12 can include a transparent panel 60, i.e., a clear plastic window which allows light into the enclosure and a plurality of ventilation openings 61, i.e., about one-half inch to three inches in diameter, openings in the flexible material 30 which allow airflow into the enclosure 27 so that the enclosure 27 does not become too hot and/or stuffy. Also, at least one of the side panels 12 can include a mirror (not shown) for personal viewing.

Preferably, for increased privacy, the portable booth 10 includes the top panel 14 attached to the upper edges 24 of each of the side panels 12 to form a roof for the enclosure 27. The top panel 14 is also made of a flexible, durable material such as nylon which is attached to the upper edges 24 of each of the side panels 12. The top panel 14 can be attached to upper edges 24 by a number of ways, including sewing, tape or velcro-type fasteners.

Preferably, the portable booth 10 also includes the bottom panel 16 attached to the lower edges 26 of each of the side panels 12 to form a floor for the portable booth 10 so that the person using the enclosure 27 is not standing on the ground. The bottom panel 16 is also made of a durable, flexible material 30 such as nylon which is attached to the lower edges 26 of the side panels 12, by sewing or some other method.

Since the top panel 14 and the bottom panel 16 are made of a flexible material 30, both panels 14, 16 merely fold along with the side panels 12 to form the multi-layer assembly 32.

The first stiffener 18 is sized and dimensioned to fit horizontally and snugly within the upper end 31 of the enclosure 27 and the second stiffener 20 is sized and dimensioned to fit horizontally and snugly within the lower end 33 of the enclosure 27. The size of first and second stiffeners 18, 20 depends upon the size of the enclosure 27. In the embodiment shown in the drawings, the first and second stiffeners 18, 20 each have a cross-sectional diameter of about 28 inches.

Typically, the first and second stiffeners 18, 20 comprise a continuous band of spring material 28 that is covered with a durable, flexible material 66. Similar to the side panels 12, the flexible material 66 can be made with nylon which is sewn around the continuous band 64. Spring steel having a width of about 1/4 inch and a thickness of about 1/32 inch provides a continuous band of spring material 28 which is strong and flexible.

Figure 8:
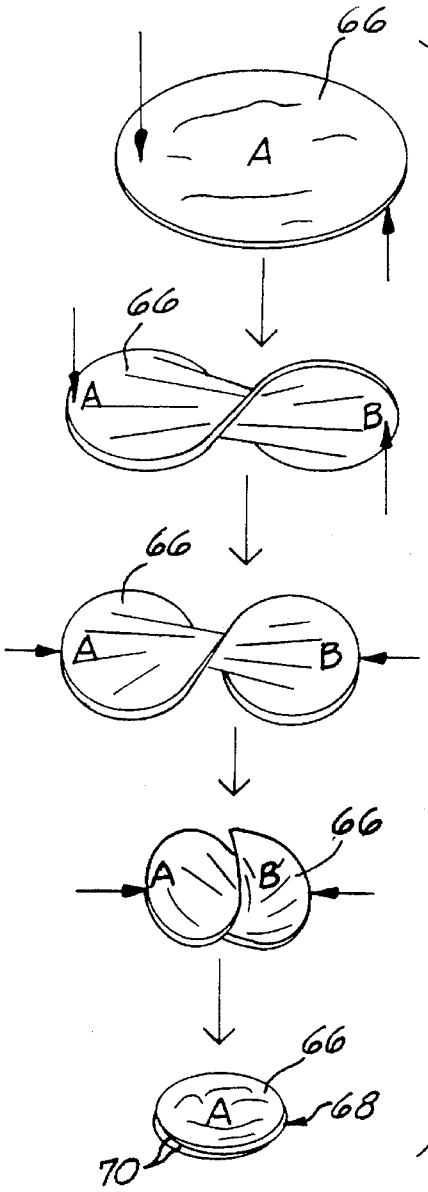
FIG. 8 is a series of perspective views illustrating one of the stiffeners being twisted to form a compact stiffener unit.

Preferably, each of the first and second stiffeners 18, 20 can be twisted to form a compact stiffening unit 68 comprising at least two substantially parallel stiffener moieties 70. As shown in FIG. 8, each of the stiffeners 18, 20 can be twisted to have three substantially parallel stiffener moieties 70, with each moiety 70 having a circular cross-section. With reference to FIG. 8, a first portion 80 of the stiffener is rotated one hundred eighty (180°) degrees relative to an opposed second portion 82 of the stiffener and then the first and second portions 80, 82 are rotated toward each other to form the stiffener moieties 70. The size of compact stiffening unit 68 depends upon the size of the first and second stiffeners 18, 20. Typically, the diameter of each of the moieties 70 varies between about six (6) to twenty (20) inches and combined height of parallel stiffener moieties 70 is between about one-half (0.5) to four (4) inches.

The portable booth 10 can include a tote bag 72 which is sized and dimensioned to retain the compact assembly unit 40 and both compact stiffener units 68. As shown in the figures, the tote bag 72 can be substantially plainer with an opening slit 74 along a top edge 74 of the tote bag 72, the length of the slit 74 being shorter than the minimum internal width. For the embodiment described herein, a tote bag 72 having a height 76 of about 14 inches and a length 78 of about 14 inches is sufficient to contain the compact assembly unit 40 and both compact stiffener units 68. A zipper 75 can be used to open and close the opening slit 74 of the tote bag 72.

Figure 4:
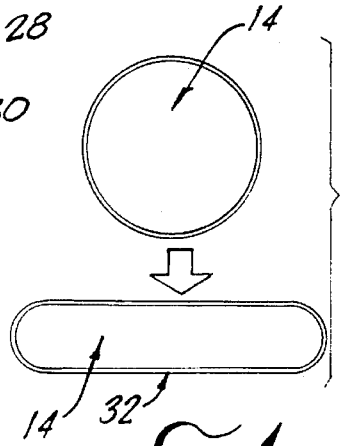
FIG. 4 is a top plan view of the portable booth illustrating the transition of the portable booth from the assembled position to when the side panels are stacked to form a multi-layer assembly.
Figure 5:
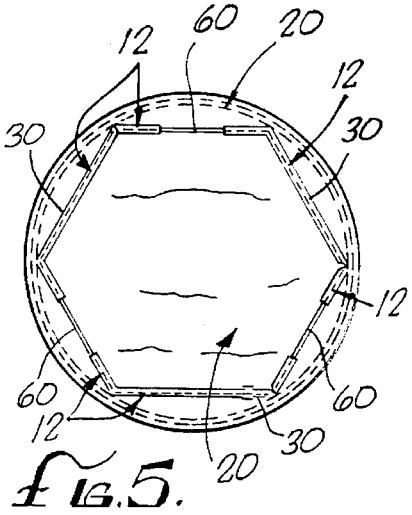
FIG. 5 is a cut-away view taken on lines 5—5 of FIG. 1.

Disassembling of the portable booth 10 is relatively easy and quick. FIG. 1 represents the portable booth 10 in the assembled position. To disassemble the portable booth 10, the first stiffener 18 and second stiffener 20 are removed from the enclosure 27 and as shown in FIG. 8, are then individually twisted to form the compact stiffener unit 68. The side panels 12 are then stacked to form the continuous multi-layer assembly 32 as shown in FIG. 4. As shown in FIG. 9, the first and second ends of the multi-layer assembly 32 are then twisted to form the compact assembly unit 40. Next, as shown in FIG. 10, the compact assembly unit 40 and the compact stiffener unit 68 are placed in the tote bag 72 for easy storage and carrying.

Assembly of the portable booth 10 is accomplished by reversing the steps detailed above.

Since the side panels 12 can be easily stacked to form a continuous multi-layer assembly 32 which can be twisted to form a compact assembly unit 40 and the first and second stiffeners 18, 20 can each be twisted to form a compact stiffener unit 68 which can fit in a small tote bag 72, the portable booth 10 is easy to assemble and disassemble, lightweight, durable and easy to transport.

Although the present invention has been described in considerable detail in reference to preferred versions, other versions are possible. Therefore, the spirit and scope of the appended claims should not be limited to the description of the preferred versions contained herein.

What is claimed is:

1. A portable booth comprising:

(a) a plurality of elongate, substantially vertical side panels, each side panel having a pair of opposed, substantially parallel side edges, an upper end edge and a lower end edge, the side panels being attached side edge to side edge to form an enclosure having an upper end and a lower end, wherein the upper end edge and the lower end edge of at least one of the side panels can be twisted in opposite rotational directions to form a compact assembly unit comprising at least two substantially parallel assembly moieties;

(b) a first stiffener comprising a continuous band of spring steel, the first stiffener being sized and dimensioned to fit horizontally and snugly within the upper end of the enclosure; and (c) a second stiffener comprising a continuous band of spring material, the second stiffener being sized and dimensioned to fit horizontally and snugly within the lower end of the enclosure;

wherein the plurality of side panels can be stacked to form a continuous multi-layer assembly having first and second ends and a longitudinal axis, and the first and second ends of the multiple-layer assembly can be twisted in opposite directions around the longitudinal axis to form a compact assembly unit comprising at least two substantially parallel assembly moieties.

2. The portable booth of claim 1 wherein each side panel comprises a flexible material covering a continuous band of spring material.

3. The portable booth of claim 2 wherein the flexible material is nylon.

4. The portable booth of claim 2 wherein the spring material is spring steel.

5. The portable booth of claim 1 wherein the compact assembly unit comprises at least three assembly moieties and each of the assembly moieties has a substantially circular cross-section.

6. The portable booth of claim 1 further comprising a flexible material top panel attached to the upper end edges of each of the side panels to form a roof for the enclosure and a flexible material bottom panel attached to the lower end edges of each of the side panels to form a floor for the enclosure.

7. The portable booth of claim 1 wherein each of the first and second stiffeners can be twisted to form a compact stiffener unit comprising at least two substantially parallel stiffener moieties.

8. The portable booth of claim 7 herein each of the stiffener moieties has a substantially circular cross-section.

9. The portable booth of claim 1 further comprising (i) a first stiffener comprising a flexible material covering a continuous band of spring material, the first stiffener being sized and dimensioned to fit horizontally and snugly within the upper end of the enclosure, and (ii) a second stiffener comprising a flexible material covering a continuous band of spring material, the second stiffener being sized and dimensioned to fit horizontally and snugly within the lower end of the enclosure, wherein each of the first and second stiffeners can be twisted to form a compact stiffener unit comprising at least three substantially parallel stiffener moieties.

10. The portable booth of claim 9 wherein each of the stiffener moieties has a substantially circular cross-section of about 9 inches.

11. The portable booth of claim 9 wherein the compact stiffener unit has a thickness between about 0.5 and 1.5 inches.

12. The portable booth of claim 9 further comprising a tote bag sized and dimensioned to retain the compact assembly units and both compact stiffener units, the tote bag having a minimum internal width.

13. The portable booth of claim 1 wherein the number of side panels is between 4 and 8.

14. The portable booth of claim 1 wherein at least one of the side panels includes a door comprising an opening coverable by a flap made of flexible material, the flap being securable over the opening with a zipper.

15. The portable booth of claim 1 wherein the compact assembly unit has a thickness between about 1.0 and 2.0 inches.

16. A portable booth comprising:

(a) a plurality of elongate, substantially vertical side panels, each side panel having a pair of opposed, substantially parallel side edges, an upper end edge and a lower end edge, each side panel comprising flexible material covering a continuous band of spring material, with one of the side panels having an access door, the side panels being attached side edge to side edge to form an enclosure having an upper end and a lower end;

(b) a flexible material top panel attached to the upper end edges of each of the side panels to form a roof for the enclosure;

(c) a flexible material bottom panel attached to the lower end edges of each of the side panels to form a floor for the enclosure;

(d) a first stiffener comprising a flexible material covering a continuous band of spring material, the first stiffener being sized and dimensioned to fit horizontally and snugly within the upper end of the enclosure; and (e) a second stiffener comprising a flexible material covering a continuous band of spring material, the second stiffener being sized and dimensioned to fit horizontally and snugly within the lower end of the enclosure;

wherein each of the two stiffeners can be twisted to form a compact stiffener unit comprising at least three substantially parallel stiffener moieties; and wherein the plurality of side panels can be stacked to form a contiguous multi-layer assembly, and such assembly can be twisted to form a compact assembly unit comprising at least three substantially parallel assembly moieties.

17. The portable booth of claim 16 wherein the compact stiffener unit has a thickness between about 0.5 and 1.5 inches and the compact assembly unit has a thickness between about 1.0 and 2.0 inches.

18. A portable booth comprising:

(a) a plurality of elongate vertical side panels, each side panel having a pair of opposed parallel side edges, an upper end edge and a lower end edge, each side panel comprising flexible material covering a continuous band of spring material, with one of the side panels having an access door, the side panels being attached side edge to side edge to form an enclosure having an upper end and a lower end;

(b) a flexible material top panel attached to the upper end edges of each of the side panels to form a roof for the enclosure;

(c) a flexible material bottom panel attached to the lower end edges of each of the side panels to form a floor for the enclosure;

(d) a first stiffener comprising a flexible material covering a continuous band or spring material, the first stiffener being sized and dimensioned to fit horizontally and snugly within the upper end of the enclosure;

(e) a second stiffener comprising a flexible material covering a continuous band of spring material, the second stiffener being sized and dimensioned to fit horizontally and snugly within the lower end of the enclosure; and (f) a tote bag sized and dimensioned to retain the compact assembly units and both compact stiffener units;

wherein each of the two stiffeners can be twisted to form a compact stiffener unit comprising at least three substantially parallel stiffener moieties;

wherein the plurality of side panels can be stacked to form a contiguous multi-layer assembly, and such assembly can be twisted to form a compact assembly unit comprising at least three substantially parallel assembly moieties;

wherein the side panels are between about 12 and about 24 inches wide;

wherein the spring material is spring steel;

wherein the number of side panels is between about 5 and about 7;

wherein the compact stiffener unit moieties are substantially circular with diameters between about 8 and 10 inches;

wherein the compact stiffener unit has a thickness between about 0.5 and 1.5 inches;

wherein the compact assembly unit moieties are substantially circular with diameters between about 10 and 20 inches; and wherein the compact assembly unit has a thickness between about 1.0 and 2.0 inches.

* * * * *